US006238328B1

(12) United States Patent
Loppnow et al.

(10) Patent No.: US 6,238,328 B1
(45) Date of Patent: May 29, 2001

(54) FOLDING DEVICE

(75) Inventors: Jay Loppnow, Fullerton; David K. Traugott, Walnut; Brian E. Keating, Anaheim Hills, all of CA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/426,377

(22) Filed: Oct. 25, 1999

Related U.S. Application Data

(62) Division of application No. 09/152,029, filed on Sep. 11, 1998, now Pat. No. 5,992,682, which is a division of application No. 08/856,355, filed on May 14, 1997, now Pat. No. 5,868,276.

(51) Int. Cl.[7] ..... B31F 1/00
(52) U.S. Cl. ..... 493/440; 493/443; 493/379
(58) Field of Search ..... 493/374, 379, 493/440, 443; 221/47, 48

(56) References Cited

U.S. PATENT DOCUMENTS

| | | | | |
|---|---|---|---|---|
| 664,885 | | 1/1901 | McGrath | 221/50 |
| 770,508 | | 9/1904 | Sexton | 221/50 |
| 1,046,325 | | 12/1912 | Normand | 221/50 |
| 1,470,280 | | 10/1923 | McCulloch | 211/50 |
| 1,857,488 | | 5/1932 | Weeks | 211/50 |
| 2,305,003 | | 12/1942 | Heit | 206/47 |
| 2,356,362 | | 8/1944 | Strandberg | 206/57 |
| 3,294,229 | | 12/1966 | McConnell | 206/57 |
| 3,307,844 | | 3/1967 | Stults | 270/40 |
| 3,401,927 | * | 9/1968 | Frick . | |
| 3,462,043 | * | 8/1969 | Frick . | |
| 3,533,533 | | 10/1970 | Chaney, Jr. | 221/25 |
| 3,679,094 | | 7/1972 | Nissen | 221/50 |
| 3,679,095 | * | 7/1972 | Nissen . | |
| 3,819,043 | | 6/1974 | Harrison | 206/449 |
| 4,563,796 | | 1/1986 | Kettlestrings | 24/563 |
| 4,706,342 | | 11/1987 | Yu | 24/679 |
| 5,332,118 | * | 7/1994 | Muckenfuhs | 221/48 |
| 5,497,903 | * | 3/1996 | Yoneyama | 221/48 |
| 6,045,002 | * | 4/2000 | Wierschke | 221/48 |

* cited by examiner

*Primary Examiner*—Eugene Kim
(74) *Attorney, Agent, or Firm*—Brinks Hofer Gilson & Lione

(57) ABSTRACT

A sheet material assembly comprising a stack of longitudinally folded sheet material webs including a first web and second web. The first web includes a first fold, a second fold overlying a portion of said first fold, and a third fold lying between the first and second folds. The second web includes a first fold underlying the first fold of the first web, a second fold overlying the second fold of the first web and a third fold underlying the third fold of the first web. A folding device for forming a web includes a first, second and third folding edge extending from a first junction and formed in a first plane, a fourth folding edge extending from the first junction out of the first plane, a fifth and sixth folding edge extending from a second junction formed in a second plane parallel to and above the first plane, and a seventh folding edge extending from the second junction out of the second plane. The fifth folding edge crosses over the third folding edge in a spaced apart relationship. A method for forming a sheet material web includes drawing the web over the second, third and fourth folding edges to form the first fold, drawing the web over the first folding edge to form a second fold and drawing the web over the fifth, sixth and seventh folding edge to form the third fold.

24 Claims, 7 Drawing Sheets

FIG.7
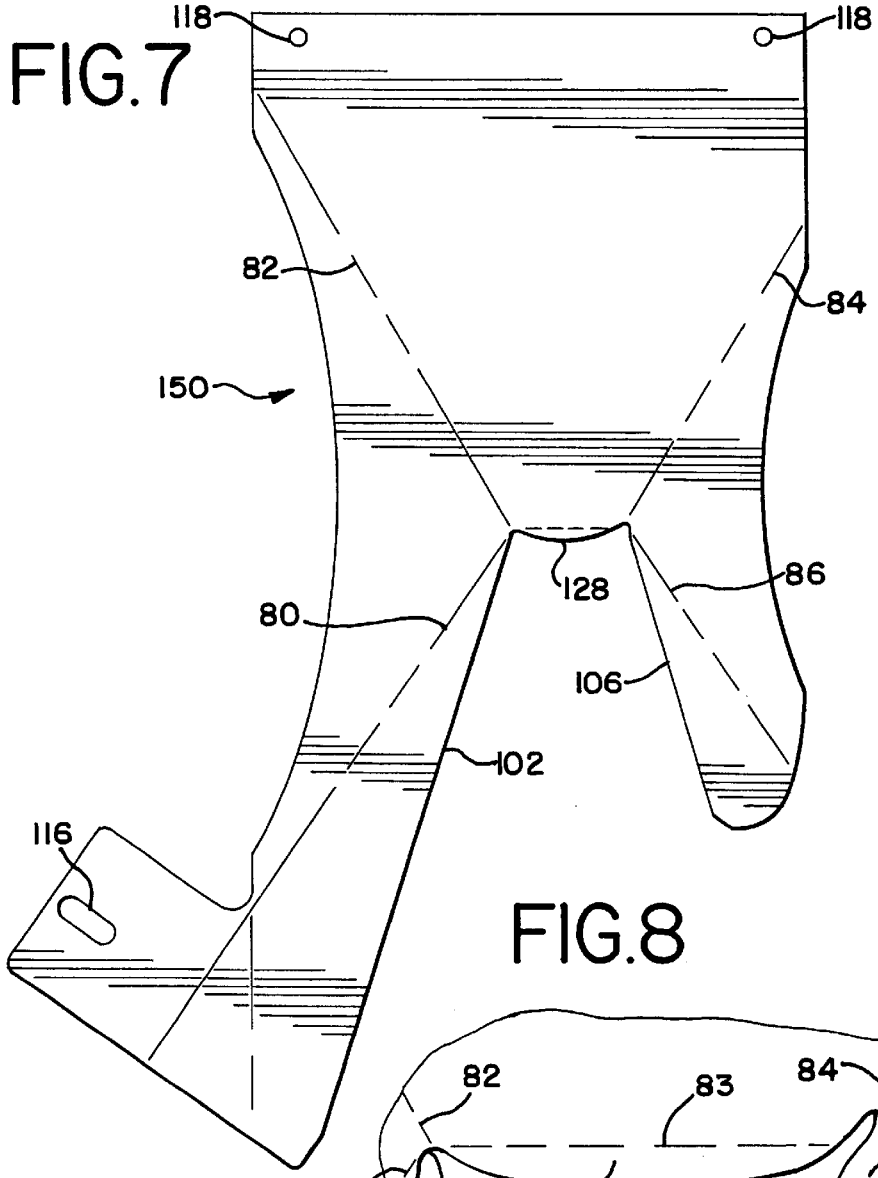
FIG.8
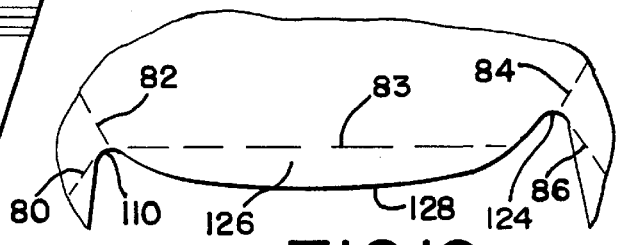
FIG.10
FIG.9
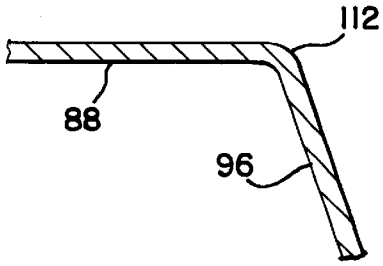
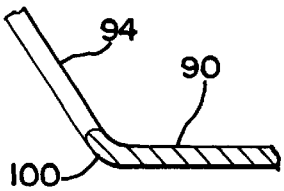

FOLDING DEVICE

CROSS-REFERENCE TO RELATED APPLICATIONS

This application is a division of U.S. application Ser. No. 09/152,029, filed Sep. 11, 1998 and now issued as U.S. Pat. No. 5,992,682, which was a division of U.S. application Ser. No. 08/856,355, filed May 14, 1997 and now issued as U.S. Pat. No. 5,868,276, which applications are hereby incorporated by reference herein.

BACKGROUND OF THE INVENTION

The present invention relates generally to a folded sheet material web and assembly, and in particular, to a specific arrangement of a starter sheet material web for a stack of folded webs. The invention also relates to a method and apparatus for folding the starter web.

It is well known in the field of facial tissue for an uppermost or starter web of a stack of longitudinally folded webs to be folded back on itself so as to provide a centrally located longitudinally folded edge on a top of the stack as described, for example, in U.S. Pat. No. 3,401,927, issued Sep. 17, 1968 to Frick, and assigned to Kimberly-Clark Corporation, the same assignee of the present application. The folded edge, and overlying folds of the starter web, are provided so as to allow a user to easily grasp and withdraw the uppermost web from the stack, which is typically retained within a carton or similar packaging. It is also well known in the art to provide a next lower web interfolded with the uppermost web so that a portion of the next lower web is withdrawn from the stack as the uppermost web is withdrawn. In this way, the next lower web is exposed to the user for successive removal from the stack.

Typically, the overlying folds of the starter web are arranged so that a single uppermost fold extends away from the centrally located longitudinally folded edge and terminates in a free edge proximate the side edge of the stack as shown in Frick U.S. Pat. No. 3,401,927. When arranged in such a configuration, a clip of webs, made from a stack of webs cut to a specified length, experiences what is commonly referred to as a "flying sheets" problem, wherein the top few sheets of the clip fly off the top of the clip as it is transported at high speeds from a saw, where the stack of webs is cut to form the clips, to a cartoner, where the clips are packaged in cartons and the like. Another problem typically encountered with a stack having a web with an uppermost fold terminating in a free edge, whether it be at the side of the stack or at a midpoint, is that the uppermost fold has a tendency to adhere both to a top pull-belt, which is used to urge the stack of webs from a folding board toward the saw, and to hold-down chains, which engage the top of the stack as it passes through the saw. In addition, because the uppermost fold presents two exposed edges, i.e., the centrally located longitudinally folded edge and the outer free edge, the folding process must be closely monitored so as to ensure that the free edge is proximate to the side edge of the stack. If the free edge extends past the side edge, it can be caught on the machinery and the like as the stack is conveyed from the folding board to the saw, and then as the clip is conveyed to the cartoner. Conversely, if the free edge is not aligned with, or falls short of, the side edge, it can present an aesthetically displeasing appearance to the user.

To combat the problem of "flying sheets" and adhesion, facial tissue manufacturers commonly are forced to reduce line speeds and/or incorporate additional manufacturing steps, such as spraying liquids on the top sheets, employing weights to hold the top sheets down, applying antistatic products to reduce static, cleaning surfaces to reduce static, and/or controlling the humidity/temperature in the relevant operating areas. Alternatively, additional folds or webs can be introduced in the top sheets, but with the adverse impact of requiring extra sheets to be dispensed on the initial withdrawal by the user. Therefore, the above-mentioned efforts can result in lower productivity, increased manufacturing costs or waste by the user.

Another problem encountered with a stack having only a single uppermost web is that the web is susceptible to tearing and the like upon removal by a user. This problem is especially acute when the uppermost web is interfolded with a next lower web, as the next lower web applies forces to the uppermost web as it is being withdrawn.

SUMMARY OF THE INVENTION

Briefly stated, the invention is directed to a sheet material assembly comprising a stack of longitudinally folded sheet material webs including a first web and second web. The first web includes a first fold, a second fold overlying a portion of the first fold, and a third fold lying between the first and second folds. The second web includes a first fold underlying the first fold of the first web, a second fold overlying the second fold of the first web, and a third fold lying between the first folds and the second folds of the first and second web.

In a preferred embodiment, the first and second folds of each of the first and second webs form a first longitudinally folded edge at a side of the stack, and the second and third folds form a second longitudinally folded edge intermediate the sides of the stack, and preferably at an approximate midpoint of the stack. Each of the third folds includes a longitudinal free edge lying between the first and second folds.

In one aspect of the invention, the longitudinal free edge of the third fold is proximate to the first longitudinal folded edge such that the first fold underlies substantially the entirety of the second fold.

In a preferred embodiment, the second and third folds of the first web are in contact, and the first, second and third folds of the first and second webs are in contact respectively.

In another aspect of the invention, a next lower web is interfolded with the first web, or the first and second webs, by providing a fold lying between the first and third folds of the webs. In a similar fashion, a plurality of next lower webs is progressively interfolded with the next lower web and each other.

In another aspect of the invention, a folding device is provided for folding a web of sheet material as described above. The folding device has a first, second and third folding edge formed in a first plane and extending from a first junction, with the third folding edge extending between the first and second folding edges. A fourth folding edge also extends from the first junction, but out of the first plane. The folding device also has a fifth and sixth folding edge formed in a second plane and extending from a second junction. The second junction is formed adjacent an end of the first edge opposite the first junction. The second plane is parallel to and positioned above the first plane. The fifth folding edge crosses over the third folding edge in a spaced apart relationship. Finally, the folding device includes a seventh folding edge that extends from the second junction, but out of the second plane.

In another aspect of the invention, the first, fourth and seventh folding edges form the edges of a first panel, the second and third folding edges form the edges of a second panel and the fifth and sixth folding edges form the edges of a third panel. In a preferred embodiment, the panels are formed out of a single piece of material, with a fourth panel interconnecting the first and second panels, and a fifth panel interconnecting the first and third panels.

In yet another aspect of the invention, a method is provided for forming the sheet material web described above. In particular, the first longitudinal fold is formed by drawing the web over the second, third and fourth folding edges of the folding device. The second longitudinal fold is formed in an overlying relationship with the first fold by drawing the web over the first folding edge of the folding device. Finally, the third longitudinal fold is formed in an overlying relationship with the first fold, and in an underlying relationship with the second fold, by drawing the web over the fifth, sixth and seventh folding edges of the folding device. In a preferred embodiment, a second web is applied to and aligned with the first web prior to the above-described forming process such that the two webs are folded together.

The present invention provides significant advantages over other longitudinally folded sheet material webs and assemblies. In particular, by folding the third fold between the first and second folds, the free edge of the third fold is isolated from and not exposed to the air currents and other forces produced by high line speeds. The free edge also is not exposed to the pull-belt that urges the stack of webs toward the saw, or to the hold-down chains engaging the top of the stack. Instead, the uppermost fold, or second fold, has folded edges, with the free edge of the third fold folded under substantially the entirety of the uppermost fold. In this way, the uppermost fold is stabilized, and is therefore less likely to be affected by static, air currents, adhesion and/or other forces tending to strip the top webs from the stack or clip.

Moreover, when two sheets are formed together in the preferred embodiment, the uppermost folds are made even more resistant to the "flying sheets" problem and/or adhesion. In contrast, when the free edge is exposed on the uppermost fold, or only turned slightly under the uppermost fold, the uppermost web is less stable. In this way, it can be made more susceptible to the "flying sheets" and adhesion problems, regardless of the number of additional sheet material webs formed with it. Therefore, with the present invention, the speed of the forming process can be substantially increased without encountering "flying sheet" or adhesion problems, and without the need for static reduction, application of weights to the top sheet, humidity control, and/or application of sprays.

Moreover, by providing two webs folded together, the sheets are made less susceptible to tearing and the like as the user withdraws the sheets and thereby also withdraws a portion of the next lower web interfolded with the two sheets.

In addition, in the present invention, the free edge of the third fold is not exposed at the side of the stack, so that it cannot be snagged on the machinery as the stack of webs travels between the folding board, the saw and the cartoner. In this way, slow-downs and stoppages can be greatly reduced.

Similarly, the free edge of the underlying third fold is not visually exposed to the user, so that it does not detract from the aesthetics of the stack.

The configuration of the improved folding board facilitates the threading of a new web after stoppages caused by breaks in the web, and the like. In particular, the folding board does not have any guide rods over which an operator must thread the web. The elimination of guide rods also makes the folding board easier to maintain and more reliable.

In addition, the configuration of the improved folding board allows the operator to more easily maintain the position of the second longitudinal folded edge at about the midpoint of the stack. In such a position, the web is made more resistant to tearing upon withdrawal by a user.

Therefore, the present invention provides a simple but reliable way to make an improved sheet material web and assembly of sheet material webs so as to reduce overall waste while simultaneously increasing output and providing a more robust product for the user.

The present invention, together with further objects and advantages, will be best understood by reference to the following detailed description taken in conjunction with the accompanying drawings.

BRIEF DESCRIPTION OF THE DRAWINGS

Many of the features and dimensions portrayed in the drawings, and in particular the presentation of folds, fold lines, folded edges, thicknesses and the like, have been somewhat exaggerated for the sake of illustration and clarity. Moreover, the webs and web folds are shown in the Figures as being spaced apart from each other and from the folding board for the sake of clarity. It should be understood that in actuality, the folds contact each other and the folding board as described below.

FIG. 7 is a plan view of the sheet metal blank from which the folding board of FIG. 3 is made.

FIG. 8 is a partial enlarged view of the two junctions and fold lines of the blank shown in FIG. 7.

FIG. 9 is a partial enlarged sectional view taken along line 9—9 of FIG. 3.

FIG. 10 is a partial enlarged sectional view taken along line 10—10 of FIG. 3.

DETAILED DESCRIPTION OF THE PREFERRED EMBODIMENTS

Figure 1:
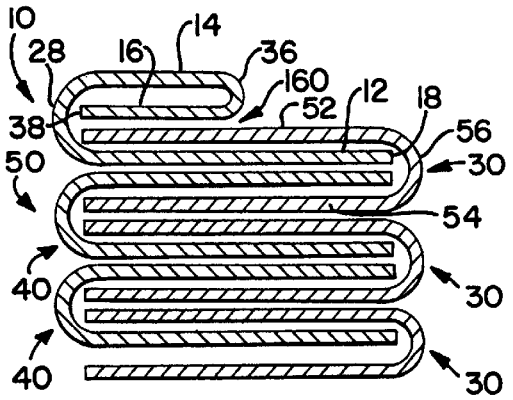
FIG. 1 is a sectional view of a stack of interfolded webs with a folded uppermost web.

Referring to the drawings, FIG. 1 shows a sheet material assembly made of a stack 50 of sheet material webs 10, 30, 40. Preferably, the sheet material webs are made of facial tissue, and are about 8½ inches wide, although it should be understood by one of skill in the art that other materials of varying widths, such as other papers or foils, can be folded and interfolded as described below. Facial tissue is a particularly fragile type of paper product that typically exhibits greater strength properties in the longitudinal or machine direction, as compared with the lateral or cross direction.

It should be understood that the term "web," as used herein, is meant to include a sheet material made of one or more plies of material so that a multiple-ply sheet material is considered to be a "web" of sheet material, regardless of the number of plies. In addition, the term "longitudinal," as used herein, is intended to indicate the direction in which the web is folded as it passes over the folding board, and is not intended to be limited to a particular length of the web, whether it is cut, as with a clip, or otherwise. Similarly, the terms "left hand," "right hand," "left" and "right" as used herein are intended to indicate the direction relative to the views presented in the Figures, and in particular, from a perspective when viewing the folding board from the front of the board.

As shown in FIG. 1, the uppermost web 10 is folded to provide longitudinal web folds 12, 14, and 16. Web fold 12 is formed from a first half of web 10 and has a longitudinal free edge 18 adjacent to a right-hand side of the stack 50 and a longitudinal folded edge 28 adjacent a left-hand side of the stack 50. In this way, web fold 12 spans substantially the width of the stack 50, which is preferably about one half of the width of web 10. Folded edge 28 is formed by folding web fold 14 over web fold 12, so that web fold 14 extends from and is bounded by folded edge 28.

In the embodiment shown in FIG. 1, web folds 14 and 16 are formed from the second half of web 10 using a left-hand folding board 70. It should be understood by one of skill in the art that the web folds can be reversed so that corresponding folds are formed from a opposite half of the web using a right-hand folding board.

Web fold 16 is folded under web fold 14 to form an inner longitudinal folded edge 36 lying between and parallel to the side edges of the stack, and preferably at about a midpoint between the side edges. In this way, folded edge 36 defines a longitudinal edge of web folds 14 and 16. Web fold 16 extends between web folds 14 and 12 toward the left-side of the stack and terminates at a longitudinal free edge 38, which lies parallel to longitudinal folded edge 28. Web folds 14 and 16 are in direct contact. Free edge 38 lies inside and adjacent to folded edge 28 and between web fold 14 and web fold 12. When folded, in this manner, the web 10 assumes a generally flattened e-shaped configuration. Preferably, free edge 38 is proximate folded edge 28 such that web fold 16 underlies substantially the entirety of web fold 14. In this way, web 10 is made less susceptible to air currents and the like. Moreover, by positioning longitudinal folded edge 36 at an approximate midpoint of the stack, web 10 is made more resistant to tearing upon withdrawal by a user.

Web folds 12 and 16 form an opening 160 between them at folded edge 36. Once the stack is cut into clips of a predetermined length and packaged in a carton or the like, the opening 160 provides a place for the user to insert one or more fingers to grasp the starter web 10 at folded edge 36 and withdraw it from the stack.

Figure 2:
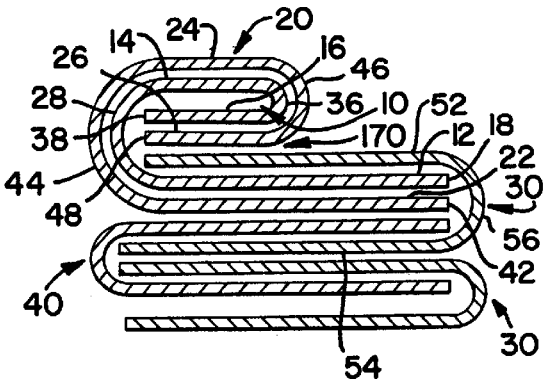
FIG. 2 is a sectional view of a stack of interfolded webs with a pair of uppermost webs folded together.

In a preferred embodiment, shown in FIG. 2, web 20 is folded with web 10. Web 20 is folded into longitudinal web folds 22, 24, and 26 which lie in direct contact with web folds 12, 14, and 16, respectively. In particular, web fold 22 underlies and is in direct contact with web fold 12, web fold 24 overlies and is in direct contact with web fold 14, and web fold 26 underlies and is direct contact with web fold 16. Web fold 22 has a longitudinal free edge 42 adjacent the right-hand side of the stack, and a longitudinal folded edge 44 adjacent the left-hand side of the stack. Folded edge 44 of web 20 overlies folded edge 28 of web 10. Web fold 24 extends between and is bounded by longitudinal folded edge 44 and longitudinal folded edge 46. Folded edge 46 runs parallel to the side edges of the stack, and preferably at about a midpoint between the side edges. Folded edge 46 of web 20 overlies folded edge 36 of web 10. Folded edge 46 is formed by folding web fold 26 under web fold 24. Web fold 26 extends from folded edge 46 into opening 160 between web folds 16 and 12 toward the side of the stack and terminates at a longitudinal free edge 48, which lies directly underneath and parallel to free edge 38. Free edge 48 also lies inside and adjacent to the folded edges 44 and 28.

Figure 26:
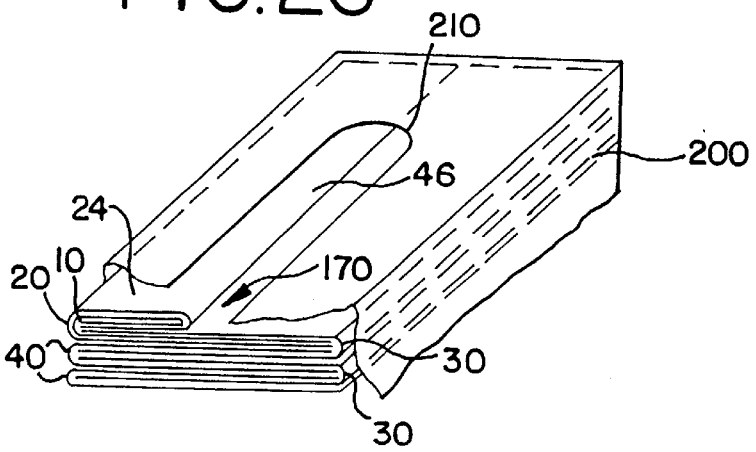
FIG. 26 is a partial perspective view of a clip of sheet material webs deposited in a carton.
Figure 20:
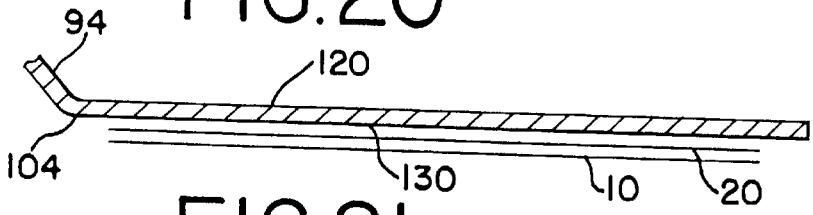
FIG. 20 is a sectional view taken along line 20—20 of FIG. 19.

Web folds 26 and 12 form an opening 170 between them at the folded edge 46. Once the stack is cut into clips of a predetermined length and packaged in a carton 200 as shown in FIG. 26, the opening 170 provides a place for the user to insert one or more fingers to grasp the starter webs 10 and 20 at folded edges 36 and 46 and withdraw them from the stack. In the embodiment shown in FIG. 26, the carton 200 is provided with a longitudinal opening 210 in a top of the carton. The opening 210 is exposed by removing a portion of the carton 200, typically by tearing the portion along a perforated line. In this way, the longitudinal folded edges 36 and 46, which are preferably centrally located in the opening 210, are exposed so that the user may insert one or more fingers through opening 210 into opening 170 and grasp the webs 10 and 20 at folded edges 36 and 46.

By providing two sheet material, webs folded together, the stack is made even less susceptible to the "flying sheets" and adhesion problems in that the air currents and the like are required to strip an additional folded web from the top of the stack. Moreover, by providing two uppermost starter webs 10 and 20 folded together, the assembly is made more robust as the two folded webs are less susceptible to tearing when being grasped and withdrawn by a user from the carton, or like packaging. In this regard, it should be understood additional starter webs can similarly be folded with the first and second webs.

As shown in FIGS. 1 and 2, right-hand V-shaped webs 30 and left-hand V-shaped webs 40 are progressively interfolded with webs 10 and 20 and each other. In particular, web 30 includes an upper fold 52 folded over a lower fold 54 to form a longitudinally folded edge 56 at the side of the stack. As shown in FIG. 1, the upper fold of the uppermost web 30 is interfolded between folds 12 and 16 of web 10. Similarly, in FIGS. 2 and 26, the upper fold 52 is interfolded between web fold 26 of web 20 and web fold 12 of web 10. Below that, webs 30 and 40 are interfolded using a succession of alternate right-hand and left-hand folding boards as described in U.S. Pat. No. 3,401,927 to Frick, which is hereby incorporated by reference.

Alternatively, the lower webs can be formed as upwardly opening C-shaped webs having a base fold, and two wing folds. In such an arrangement, the lower webs are not interfolded, but rather are stacked one upon the other.

Folding board 70, conveniently called a left-hand board as shown in the Figures, is preferably formed from a single piece of sheet metal, or blank 150, as shown in FIG. 7. The sheet metal blank is preferably made from #12 Gauge Type 304 Stainless Steel with a #4 finish on both sides. However, it should be understood by one of skill in the art that the folding board can be made out of any rigid material having a suitably smooth surface and edges, such as aluminum or even plastic. The sheet metal blank 150 is bent along bend lines 80, 82, 83, 84 and 86 to form folding board 70. Alternatively, the folding board can be constructed of several pieces of sheet metal welded together, or mechanically fastened.

Figure 3:
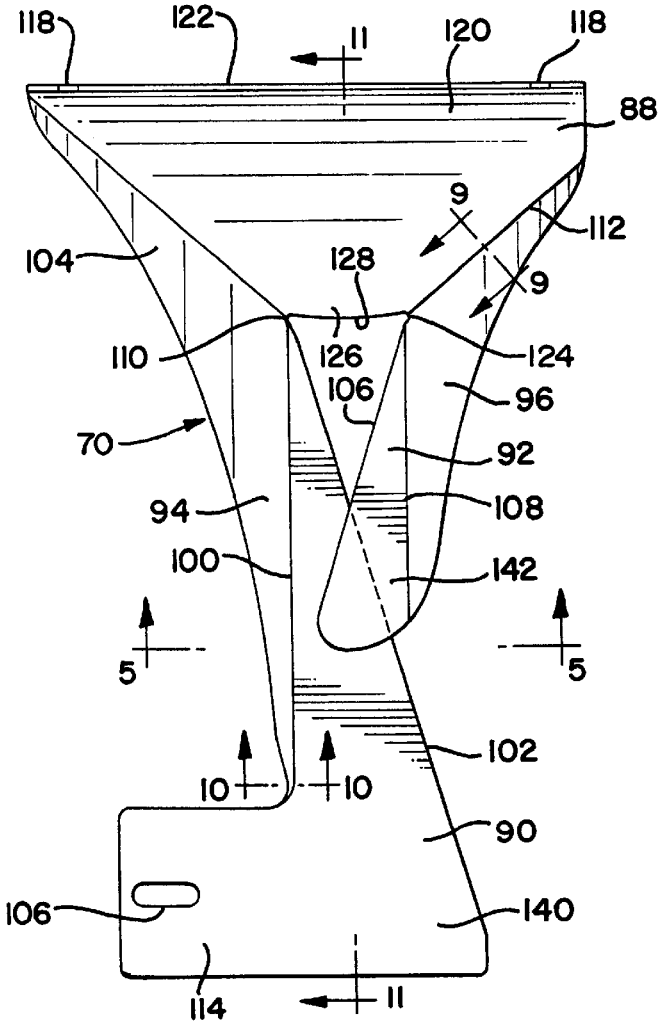
FIG. 3 is a top plan view of a folding board.
Figure 12:
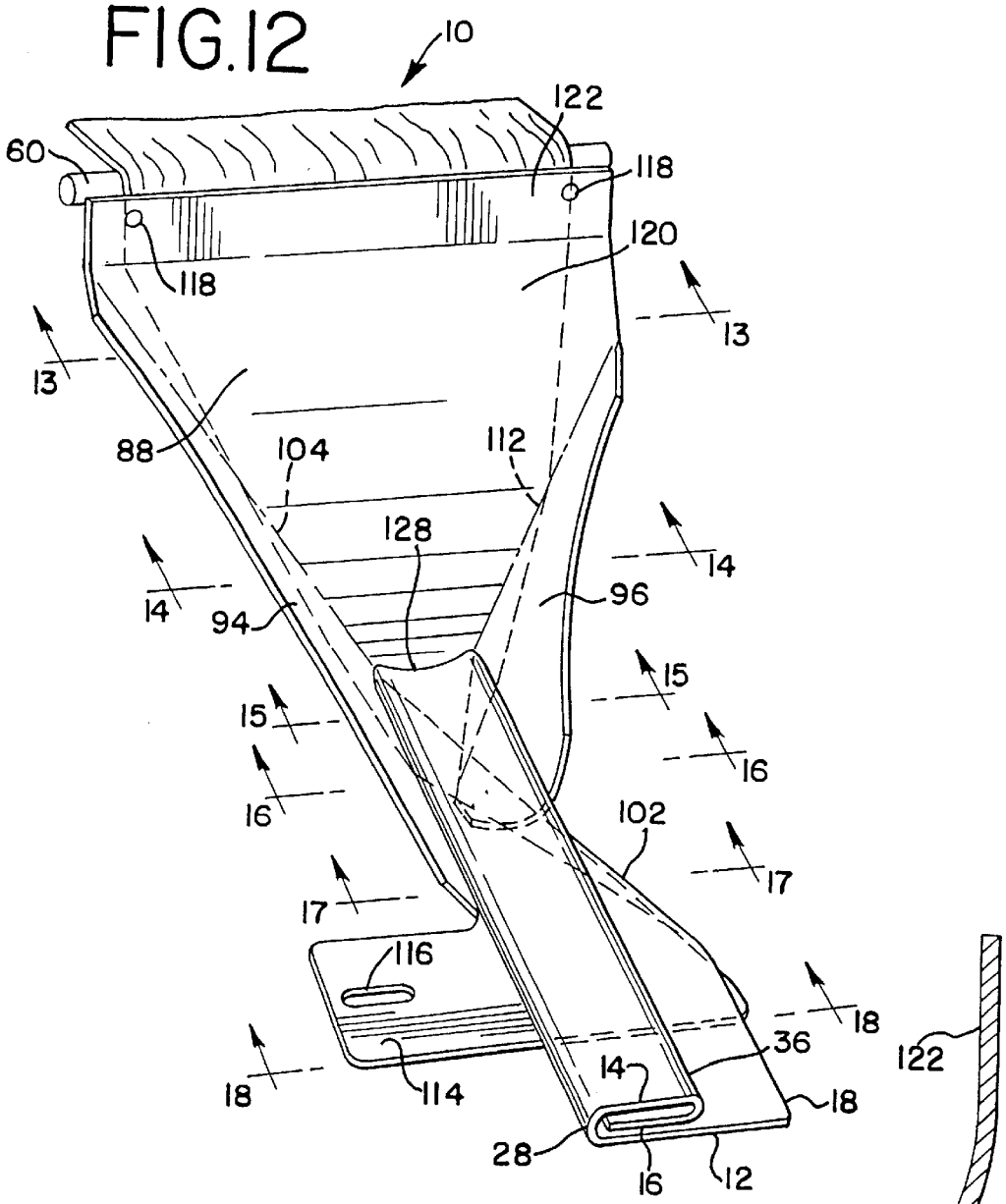
FIG. 12 is a top perspective view of a web applied to the folding board of FIG. 3.
Figure 11:
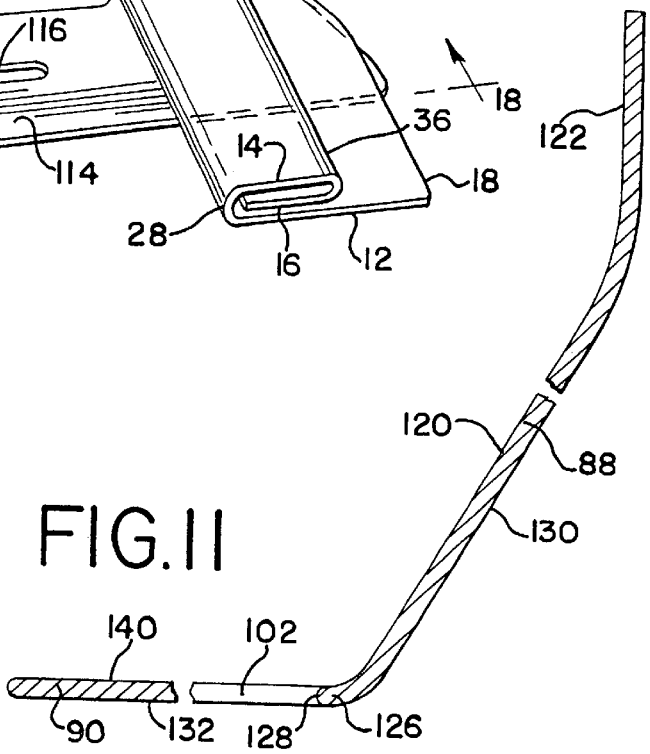
FIG. 11 is a partial enlarged sectional view taken along line 11—11 of FIG. 3.
Figure 19:
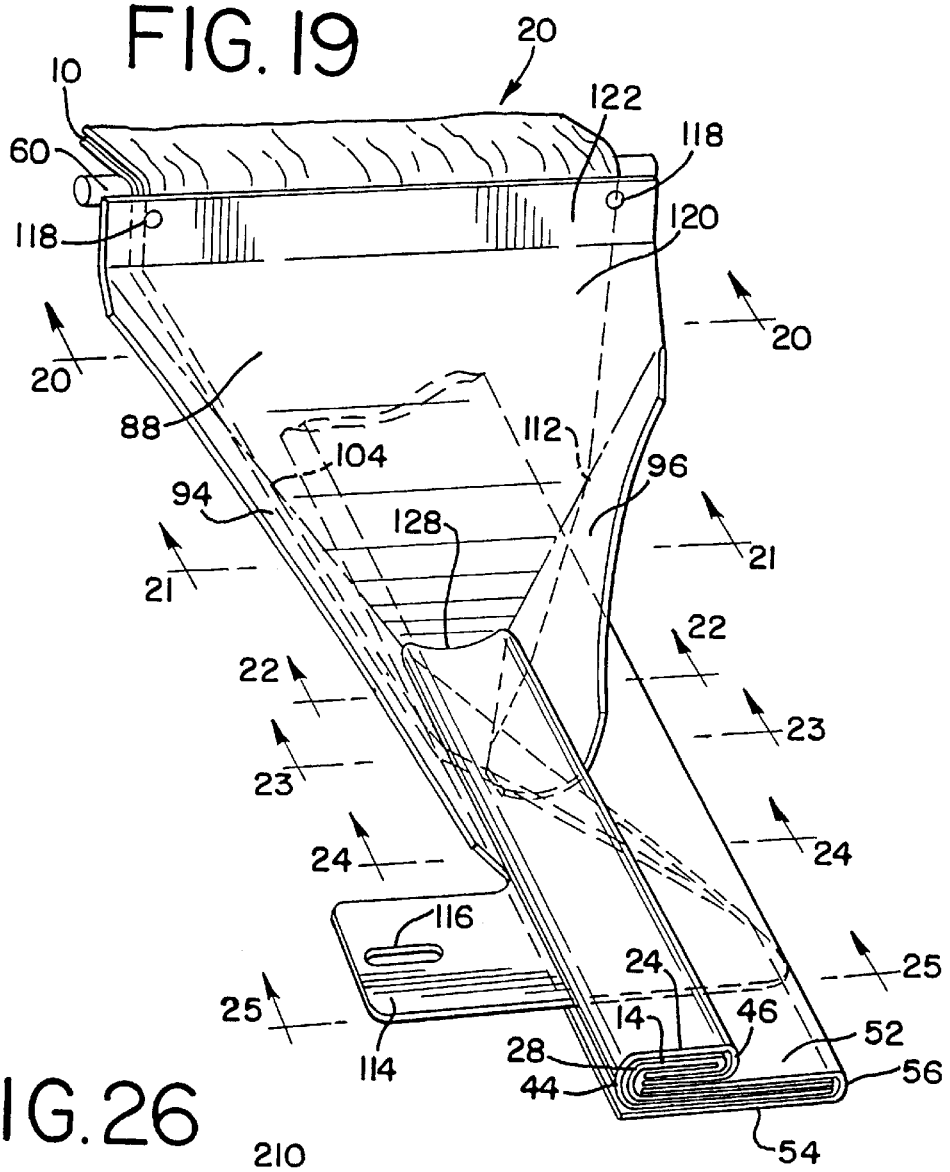
FIG. 19 is a top perspective view of a first and second web applied to the folding board of FIG. 3 with a third web interfolded with the first and second webs.

Folding board 70 includes panels 88, 90, 92, 94 and 96. Panel 90 may be considered as a base portion, and is typically used in a horizontal position. Panels 90 and 94 are formed by bending the blank 150 along bend line 80 so as to form a folding edge 100 that extends parallel to the path of the webs 10, 20 as shown in FIGS. 3, 12 and 19. Preferably, panels 90 and 94 are bent at about an angle of 123°, 45' as shown in FIG. 10. Panel 90 also includes a free folding edge 102 that extends obliquely across the path of the webs 10, 20 and intersects folding edge 100 at junction 110. Panel 90 also includes a sidewardly extending mounting flange 114 having a slotted mounting hole 116 adapted to allow the folding board 70 to be mounted to a support structure, shown in FIG. 4 as a post 180 for the sake of illustration. Preferably, folding edges 100 and 102 of panel 90 form an angle of about 17°, 9' between them and lie in the same plane.

Panel 88 is generally trapezoidal in shape and is formed by bending the blank 150 along bend lines 82 and 84 to form folding edges 104 and 112, which also define the edges of panels 94 and 96 respectively. Preferably, panels 96 and 88 are bent at about an angle of 106°, 6' along bend line 84 to form folding edge 112. Similarly, panels 88 and 94 are bent about the same amount to form folding edge 104. Panel 88 includes a generally flat portion 120 having a bottom surface 130, and an upper lip portion 122 that lies generally in a vertical plane. Preferably, flat portion 120 forms an angle of about 60° with the plane defined by panel 90. The upper lip portion 122 includes two mounting holes 118 adapted to allow the folding board 70 to be mounted to a support structure, shown in FIG. 4 as a post 190 for the sake of illustration. Panel 88 also includes a lower lip portion 126 that extends forwardly from the flat portion 120 and terminates at folding edge 128. Folding edge 128 extends between junctions 110 and 124 and lies generally in the same plane formed by panel 90 and folding edges 100 and 102. Junction 110 and 124 are each formed as a rounded notch, preferably having a radius of about 0.09 inches. As shown in FIGS. 7 and 8, junction 124 is slightly offset from, or positioned slightly higher than, junction 110, so that when the blank is bent along bend lines 80, 82, 83, 84 and 86 as described above, panel 92 is formed parallel to and spaced apart from panel 90 in an overlying fashion.

Figure 4:
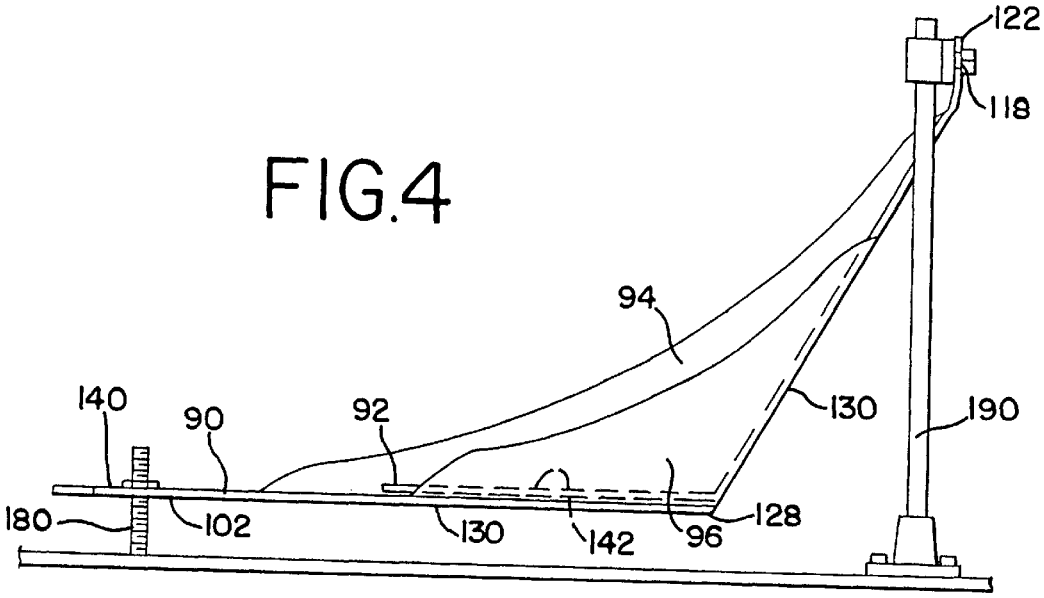
FIG. 4 is a side elevational view of the folding board.
Figure 5:
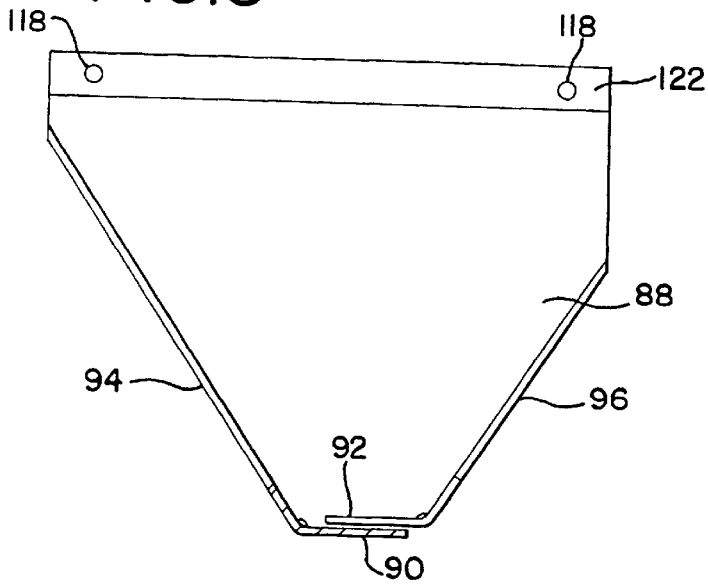
FIG. 5 is sectional view of the folding board taken along line 5—5 of FIG. 3.
Figure 6:
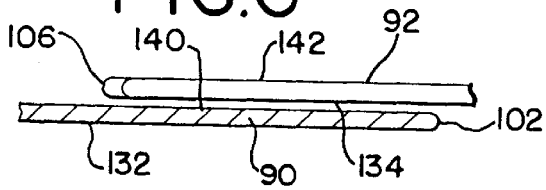
FIG. 6 is a partial enlarged view of the overlying horizontal panels of the folding board shown in FIG. 5.

As just described, panel 92 also is typically used in the horizontal position and lies parallel to and above panel 90 as shown in FIGS. 5 and 6. Preferably panel 92 is spaced about 0.06 inches above panel 90. Panels 92 and 96 are formed by bending the blank along bend line 86 so as to form a folding edge 108 that extends parallel to folding edge 100 and to the path of the web as shown in FIGS. 3, 12 and 19. Preferably, panels 92 and 96 are bent to form an angle of about 123°, 45'. Panel 92 also includes free folding edge 106, which extends obliquely across the path of the web and intersects folding edge 108 at junction 124. Preferably, folding edges 106 and 108 of panel 92 form an angle of about 17°, 9' between them and lie in the same plane. As shown in FIGS. 4, 5 and 6, a portion of panel 92 overlies a portion of panel 90, so that folding edge 106 crosses over folding edge 102 in a spaced apart relationship.

Panel 96 extends between panels 88 and 92 and is formed by bending the blank along bend lines 84 and 86 as described above. Panel 94 extends between panels 88 and 90 and is formed by bending the blank along bend lines 80 and 82 as described above.

Figure 13:
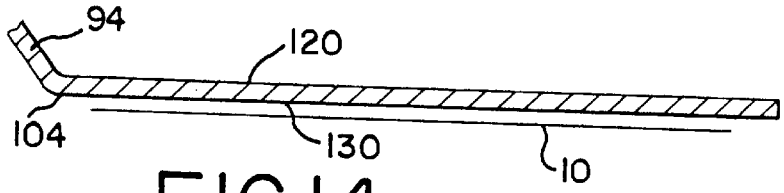
FIG. 13 is a sectional view taken along line 13—13 of FIG. 12.
Figure 14:
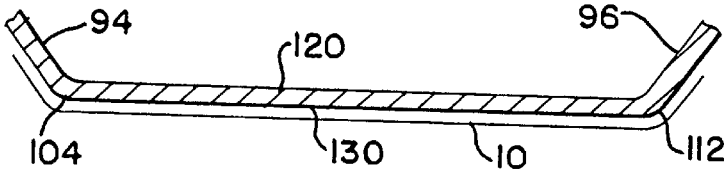
FIG. 14 is a sectional view taken along line 14—14 of FIG. 12.

To form the folded web configuration shown in FIG. 1, web 10 is initially provided as a roll of sheet material (not shown). Referring to FIG. 12, the web 10 is pulled from the roll and directed over a guide roll 60 under suitable tension and thereby introduced to the folding board 70 in a generally flat condition as shown in FIGS. 12 and 13. The web 10 is longitudinally directed against the bottom surface of the folding board 70. Initially, the web 10 is directed against the bottom surface 130 of panel 88 and drawn across folding edges 104 and 112 as shown in FIG. 14.

Figure 15:
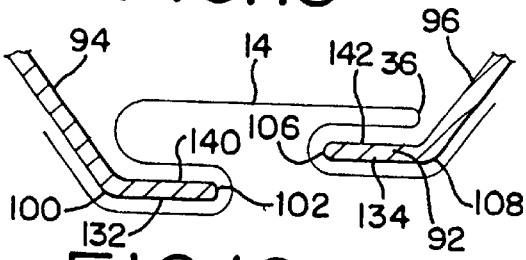
FIG. 15 is a sectional view taken along line 15—15 of FIG. 12.

As the web 10 continues to pass under the board 70, it is drawn across folding edge 128 to form web fold 14 as shown in FIG. 15. In particular, as the web 10 is drawn over folding edge 102 and top surface 140, it is urged inwardly to form longitudinal folded edge 28 at junction 110, and to begin to form web fold 12. Similarly, the web 10 is drawn over and urged inwardly by folding edge 106 to form the longitudinal folded edge 36 at junction 120, which lies parallel to folded edge 28. The web also begins to form web fold 16 as it is drawn over folding edge 106 and the top surface 142 of panel 92. The left-hand side of the web also is drawn over folding edge 100 and the bottom surface 132 of panel 90, while the right-hand side is drawn over folding edge 108 and the bottom surface 134 of panel 92.

Figure 16:
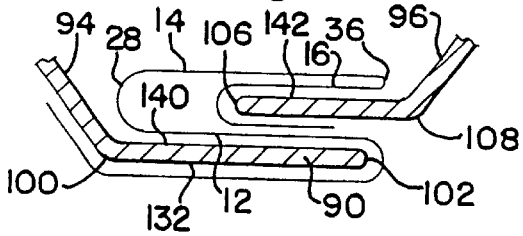
FIG. 16 is a sectional view taken along line 16—16 of FIG. 12.
Figure 17:
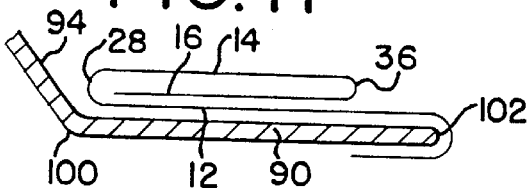
FIG. 17 is a sectional view taken along line 17—17 of FIG. 12.
Figure 18:
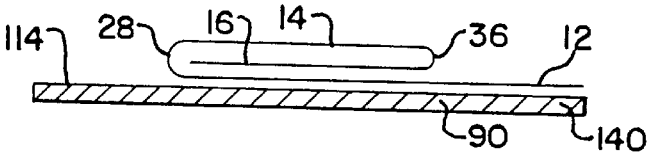
FIG. 18 is a sectional view taken along line 18—18 of FIG. 12.

As the web 10 is continued to be drawn over folding edge 106, which extends obliquely inward from junction 124, the web fold 16 is progressively urged by folding edge 106 beneath web fold 14 as shown in FIG. 16. Similarly, folding edge 102, which extends obliquely inward from juncture 110, progressively urges web fold 12 beneath web fold 14 as the web 10 is drawn over folding edge 102. Because panel 92 and folding edge 106 are spaced above panel 90 and folding edge 102, web fold 12 is also progressively urged beneath web fold 16, so that web fold 16 is formed between web folds 12 and 14. Eventually, as shown in FIG. 17, web fold 16 is completely formed between web folds 12 and 14 as panel 92 and folding edge 106 end, so that free edge 38 lies between the web folds 12 and 14 inside and adjacent to the folded edge 28. In this way, the free edge 38 is completely hidden from view and protected between web folds 12 and 14. As shown in FIG. 17, the web 10 continues to be drawn over folding edge 102 and the bottom surface 132 of panel 90 so as to complete the formation of web fold 12. As shown in FIG. 18, the completed folded sheet material web is shown as it is drawn over the top surface 140 of panel 90.

As just described, the improved folding board 70, and method for folding a starter web, eliminates the need for guide rods, and thereby simplifies the folding board and the overall process for making a folded sheet. This, in turn, makes it easier to initially thread the machine and to maintain the device. Moreover, less attention is required to maintain the positioning of the free edge 38, since it is not visually exposed to the user, and cannot be snagged by the machinery and the like as the web is conveyed from the folding board 70 to the saw, and to the cartoner thereafter. Similarly, the configuration of the folding board 70 makes it easier for the operator to maintain the longitudinal folded edge 36 at about the midpoint of the stack, wherein it is made accessible to the user and wherein web 10 also is made more robust to tearing and the like.

Figure 21:
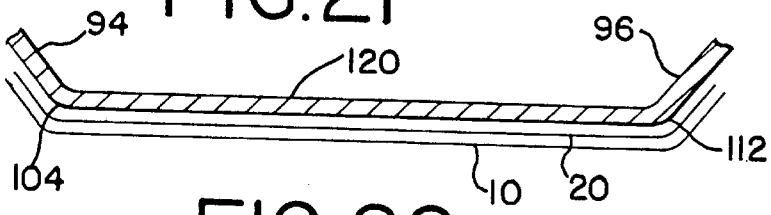
FIG. 21 is a sectional view taken along line 21—21 of FIG. 19.

In the preferred embodiment, a second roll (not shown) of sheet material web 20 is provided and is applied directly over and aligned with web 10 as the webs pass over guide roll 60 as shown in FIG. 19. Similarly, it should be understood that additional sheet material webs can be provided and applied to the first and second webs. The webs are formed together as they are drawn across the folding board 70 as described above for the single web 10, and as shown in FIGS. 19–25. In particular, the webs 10 and 20, with web 20 overlying web 10, are longitudinally directed against the bottom surface of the folding board 70. Initially, the webs 10 and 20 are directed against the bottom surface 130 of panel 88 and drawn across folding edges 104 and 112 as shown in FIG. 21.

Figure 22:
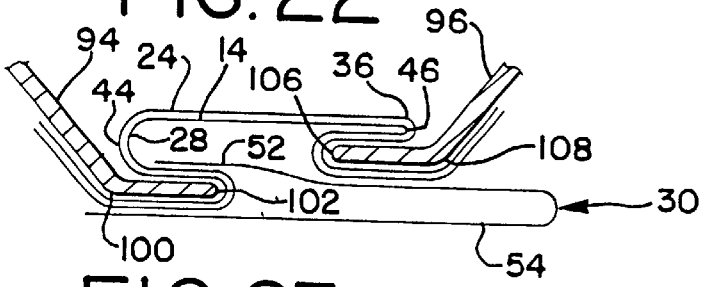
FIG. 22 is a sectional view taken along line 22—22 of FIG. 19.

As the webs 10 and 20 continue to be drawn beneath the board 70, they are drawn across folding edge 128 to form web folds 14 and 24 as shown in FIG. 22. In particular, as the webs 10 and 20 are drawn over folding edge 102, they are urged inwardly to form longitudinally folded edges 28 and 44 at junction 110, and to begin to form web folds 12 and 22. Similarly, the webs 10 and 20 are drawn over and urged inwardly by folding edge 106 to form longitudinally folded edges 36 and 46, which lie parallel to folded edges 28 and 44. The webs 10 and 20 also begin to form web folds 16 and 26 as they are drawn over folding edge 106 and the top surface 142 of panel 92. The left-hand sides of the webs also are drawn over folding edge 100 and the bottom surface 132 of panel 90, while the right-hand sides are drawn over folding edge 108 and the bottom surface 134 of panel 92.

Figure 23:
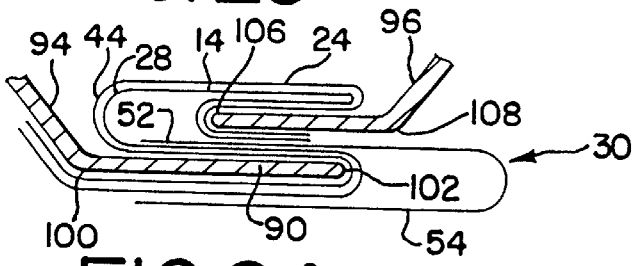
FIG. 23 is a sectional view taken along line 23—23 of FIG. 19.
Figure 24:
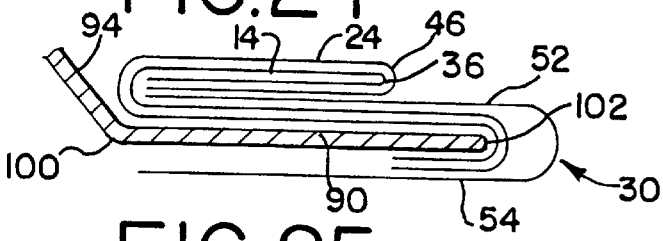
FIG. 24 is a sectional view taken along line 24—24 of FIG. 19.
Figure 25:
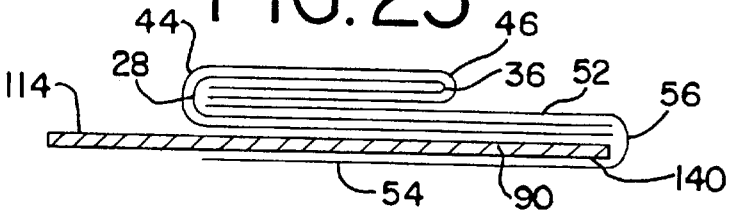
FIG. 25 is a sectional view taken along line 25—25 of FIG. 19.

As the webs 10 and 20 are drawn over folding edge 106, which extends obliquely inward from junction 124, the web folds 16 and 26 are progressively urged by folding edge 106 beneath web folds 14 and 24 as shown in FIG. 23. Similarly, folding edge 102, which extends obliquely inward from juncture 110, progressively urges web folds 12 and 22 beneath web folds 14 and 24 as the webs 10 and 20 are drawn over folding edge 102. Because panel 92 and folding edge 106 are spaced above panel 90 and folding edge 102, web folds 12 and 22 are also progressively urged beneath web folds 16 and 26, so that web folds 16 and 26 are folded between web folds 12 and 14. Eventually, as shown in FIG. 24, the web folds 16 and 26 are completely formed between web folds 12 and 14 as panel 92 ends, so that free edges 38 and 48 lie between the web folds 12 and 14 inside and adjacent to folded edges 28 and 44. In this way, the free edges 38 and 48 are completely hidden from view and protected between web folds 12, 22, 14 and 24. As shown in FIG. 24, the webs 10 and 20 continue to be drawn over folding edge 102 of panel 90 so as to complete the formation of web folds 12 and 22. As shown in FIG. 25, the completed folded sheet material webs are shown as they are drawn over the top surface 140 of panel 90.

By providing an additional web 20 folded with web 10, the starter webs are less susceptible to tearing and the like when grasped by a user during the initial withdrawal of the starter webs. In addition, the stack is made more resistant to the "flying sheets" and adhesion problems.

An interfolded stack of sheet material webs is produced by interfolding webs 10, 20, 30 and 40 using a preceding succession of conventional alternate right-hand and left-hand folding boards, as taught, for example, in U.S. Pat. No. 3,401,927 to Frick, referred to above. For example, the uppermost V-shaped web 30 is interfolded with right-hand webs 10 and 20 by passing the upper fold 52 of the web, which is formed by a conventional board immediately preceding folding board 70, over the top surface of panel 90 as shown in FIGS. 19–25. Similarly, the next lower V-shaped web 40, formed as a left-hand web, is folded by a conventional folding board immediately preceding the right-hand board so as to interfold webs 30 and 40.

After the stack of webs exits the last folding board 70, it is carried by belts, including a top pull-belt, to a saw, where the stack is cut laterally across its width to a desired length so as to produce a series of clips. The clips then are carried to a cartoner where they are deposited in a carton, as shown in FIG. 26, or other like packaging. Because the free edges 38 and 48 of web folds 16 and 26 lie inside folded edges 28 and 44 of webs 10 and 20, and are disposed between web folds 14 and 12, they are not exposed as the uppermost fold of the stack. Accordingly, the uppermost webs 10 and 20 are less susceptible to being stripped off the top of the clip by air currents, and the like, typically termed the "flying sheets" problem, as the clips are transported from the saw to the cartoner. Instead, the uppermost fold 14 is now bounded by opposite folded edges 28 and 36. Moreover, free edge 38 and 48 are positioned inside folded edge 28 and 44 and between web folds 12 and 14 so as to not be exposed to machinery and the like. In this way, the free edges 38 and 48 cannot be snagged along the side of the clip and thereby be stripped from the clip, along with any additional interfolded webs. In addition, by folding the free edges 38 and 48 between web folds 12 and 14, they are not exposed to the top-pull belt urging the stack towards the saw, or to the hold-down chains that direct the stack through the saw. Therefore, the stack is less susceptible to having the uppermost folds or webs adhere to one of the belt or chain and thereby tear, break or otherwise cause a stoppage of the line. By greatly reducing the "flying sheets" and adhesion problems, the speed at which the webs are directed over the folding boards and thereafter introduced to the saws and cartoner can be greatly increased, without the accompanying breaks and waste associated with stacks of sheet material webs interfolded in the conventional manner.

As described above, a succession of alternating folding boards can be provided to produce as high a stack of webs as is desired, depending on the number of webs and folding boards. By providing interfolded webs, a portion of the next lower web 30 in a clip is automatically withdrawn by and with the starter web so as to provide a portion of the web 30 for the user to grasp upon the next withdrawal. The opening 170 provided between web folds 26 and 12 at folded edge 46 allows the user to insert one or more fingers to grasp and withdraw the starter webs 10 and 20. As the user withdraws the next lower web 30 from the clip, it automatically withdraws a portion of the next lower web 40 due to the interfolded nature of the webs 30, 40, and so on. In this way, the successive withdrawal of a web ensures that a portion of the next lower web is also withdrawn.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A folding device for folding a web of sheet material comprising first, second and third folding edges extending from a first junction and formed in a first plane, said third folding edge extending from said first junction between said first and second folding edges, a fourth folding edge extending from said first junction and out of said first plane, whereby a first longitudinal fold of the web may be drawn over and formed by said second, third and fourth folding edges, and a second longitudinal fold of said web may be drawn over and formed by said first folding edge in an overlying relationship with said first fold, a fifth and sixth folding edge extending from a second junction formed adjacent an end of said first folding edge opposite said first junction, said fifth and sixth folding edges formed in a second plane parallel to and above said first plane, said fifth folding edge crossing over said third folding edge in a spaced apart relationship, a seventh folding edge extending from said second junction and out of said second plane, whereby a third longitudinal fold of said web may be drawn over and formed by said fifth, sixth and seventh folding edges in an overlying relationship with said first fold and in an underlying relationship with said second fold.

2. The folding device of claim 1 wherein said first, fourth and seventh folding edges form edges of a panel.

3. The folding device of claim 1 wherein said fifth and sixth folding edges form edges of a panel.

4. The folding device of claim 1 wherein said second and third folding edges form edges of a panel.

5. The folding device of claim 1 wherein said first, fourth and seventh folding edges form edges of a first panel, said second and third folding edges form edges of a second panel, and said fifth and sixth folding edges form edges of a third panel.

6. The folding device of claim 5 wherein said first, second and third panels are formed out of a single piece of material.

7. The folding device of claim 5 further comprising a fourth panel interconnecting said first and second panels, and a fifth panel interconnecting said first and third panels.

8. A folding device for folding a sheet material web comprising a first panel comprising a first, fourth and seventh folding edge, a second panel comprising a second and third folding edge and a third panel comprising a fifth and sixth folding edge, said second and third panels in parallel and spaced apart relationship wherein a portion of said third panel overlies said second panel; whereby a first longitudinal fold of the web may be drawn over and formed by said fourth folding edge of said first panel and said second and third folding edges of said second panel, and a second longitudinal fold of said web may be drawn over and formed by said first folding edge of said first panel in an overlying relationship with said first fold, and a third longitudinal fold of said web may be drawn over and formed by said seventh folding edge of said first panel and said fifth and sixth folding edge of said third panel in an underlying relationship with said first fold and in an overlying relationship with said second fold.

9. The folding device of claim 8 further comprising a fourth panel interconnecting said first and second panels, and a fifth panel interconnecting said first and third panels.

10. The folding device of claim 8 further comprising a support structure supporting at least one of said first, second and third panels.

11. The folding device of claim 8 wherein said first, second and third panels are formed from a single piece of material.

12. A folding device for folding a web of sheet material comprising first, second and third folding edges extending from a first junction, wherein said second and third folding edges are formed in a first plane, and wherein said third folding edge extends from said first junction between said first and second folding edges, a fourth folding edge extending from said first junction and out of said first plane, a fifth and sixth folding edge extending from a second junction formed adjacent an end of said first folding edge opposite said first junction, said fifth and sixth folding edges formed in a second plane parallel to and spaced apart from said first plane, said fifth folding edge crossing over said third folding edge in a spaced apart relationship, and a seventh folding edge extending from said second junction and out of said second plane.

13. The folding device of claim 12 wherein said first, fourth and seventh folding edges form edges of a panel.

14. The folding device of claim 12 wherein said fifth and sixth folding edges form edges of a panel.

15. The folding device of claim 12 wherein said second and third folding edges form edges of a panel.

16. The folding device of claim 12 wherein said first, fourth and seventh folding edges form edges of a first panel, said second and third edges form edges of a second panel, and said fifth and sixth folding edges form edges of a third panel.

17. The folding device of claim 16 wherein said first, second and third panels are formed out of a single piece of material.

18. The folding device of claim 16 further comprising a fourth panel interconnecting said first and second panels, and a fifth panel interconnecting said first and third panels, wherein said first, second, third, fourth and fifth panels are formed from the same piece of material.

19. The folding device of claim 12 wherein said first junction is formed as a rounded notch.

20. The folding device of claim 12 wherein said second junction is formed as a rounded notch.

21. The folding device of claim 1 wherein said first folding edge comprises a curved lip portion.

22. The folding device of claim 8 wherein said first folding edge comprises a curved lip portion.

23. The folding device of claim 12 wherein said first folding edge comprises a curved lip portion.

24. The folding device of claim 12 wherein said first folding edge is formed in said first plane.

* * * * *